US008365561B2

(12) United States Patent
Chang

(10) Patent No.: US 8,365,561 B2
(45) Date of Patent: Feb. 5, 2013

(54) ELECTRIC DOOR LOCK

(75) Inventor: Jing-Chen Chang, Yu-Lin Hsien (TW)

(73) Assignee: Yeong Du Trading Co., Ltd., Chiayi (TW)

( * ) Notice: Subject to any disclaimer, the term of this patent is extended or adjusted under 35 U.S.C. 154(b) by 197 days.

(21) Appl. No.: 12/855,596

(22) Filed: Aug. 12, 2010

(65) Prior Publication Data

US 2012/0036904 A1 Feb. 16, 2012

(51) Int. Cl.
*E05B 47/00* (2006.01)

(52) U.S. Cl. ..... 70/472; 70/149; 70/218; 70/223; 70/277; 70/278.7; 70/279.1; 292/142; 292/144

(58) Field of Classification Search ..... 70/280–282, 70/222, 223, 188–190, 278.7, 277, 279.1, 70/422, 472, 149, 218; 192/52.6, 56.6, 56.62; 292/142, 144, DIG. 27; 464/36, 38
See application file for complete search history.

(56) References Cited

U.S. PATENT DOCUMENTS

| | | | | | |
|---|---|---|---|---|---|
| 1,565,754 | A * | 12/1925 | Orth | 464/39 |
| 1,611,940 | A * | 12/1926 | Ohmer | 464/37 |
| 2,571,879 | A * | 10/1951 | Charles Hill et al. | 464/36 |
| 2,716,875 | A * | 9/1955 | Charles Hill et al. | 464/38 |
| 3,754,412 | A * | 8/1973 | Briggs | 192/17 C |
| 4,438,962 | A * | 3/1984 | Soloviff et al. | 292/144 |
| 4,497,226 | A * | 2/1985 | Horwitt | 81/474 |
| 4,941,697 | A * | 7/1990 | Fan | 292/336.3 |
| 6,012,310 | A * | 1/2000 | Hsiao | 70/278.2 |
| 6,471,257 | B1 * | 10/2002 | Lu et al. | 292/144 |
| 6,517,127 | B1 * | 2/2003 | Lu et al. | 292/144 |
| 6,807,834 | B2 * | 10/2004 | Tsai | 70/472 |
| 6,832,500 | B1 * | 12/2004 | Chen | 70/223 |
| 7,516,633 | B1 * | 4/2009 | Chang | 70/472 |
| 7,543,469 | B1 * | 6/2009 | Tseng et al. | 70/472 |
| 7,770,423 | B2 * | 8/2010 | Wu | 70/218 |
| 7,827,837 | B2 * | 11/2010 | Huang et al. | 70/277 |
| 2005/0044908 | A1 * | 3/2005 | Min | 70/276 |
| 2005/0183476 | A1 * | 8/2005 | Feucht et al. | 70/186 |
| 2007/0169525 | A1 * | 7/2007 | Chang | 70/472 |
| 2008/0047309 | A1 * | 2/2008 | Okuno et al. | 70/252 |
| 2009/0173120 | A1 * | 7/2009 | Lin et al. | 70/279.1 |
| 2009/0211320 | A1 * | 8/2009 | Wu | 70/277 |
| 2011/0185554 | A1 * | 8/2011 | Huang et al. | 29/428 |

* cited by examiner

*Primary Examiner* — Lloyd Gall
(74) *Attorney, Agent, or Firm* — Steptoe & Johnson LLP

(57) ABSTRACT

An electric door lock includes a door latch mechanism movable between latching and unlatching positions, a manual operation mechanism, and first and second rotatable members. The manual operation mechanism is manually operable to drive movement of the door latch mechanism between the latching and unlatching positions. The first rotatable member is rotatable about an axis, and includes a rotary body and a clutch mechanism. The clutch mechanism is disposed resiliently on the rotary body and is movable parallel to the axis toward and away from the rotary body. The second rotatable member is coupled to the manual operation mechanism for co-rotation therewith, and has one side that confronts the first rotatable member and that is provided with a pushed unit.

11 Claims, 10 Drawing Sheets

ELECTRIC DOOR LOCK

BACKGROUND OF THE INVENTION

1. Field of the Invention

The present invention relates to an electric door lock, more particularly to an electric door lock that can be operated either manually or electrically.

2. Description of the Related Art

In U.S. Patent Application Publication No. 2007/0169525, there is disclosed a conventional electric door lock operable either manually or electrically. The conventional electric door lock includes a latching unit, a manual operating member, first and second rotatable members, and an electric driving unit. The latching unit is movable between latching and unlatching positions. The manual operating member is rotatable between a first angular position so as to dispose the latching unit at the latching position, and a second angular position so as to dispose the latching unit at the unlatching position. The first rotatable member is provided with a first protrusion, and is sleeved securely on the manual operating member so as to be co-rotatable therewith. The second rotatable member is provided with a second protrusion, and is rotatable in a first rotational direction such that the second protrusion pushes the first protrusion so as to move the first rotatable member from the first angular position to the second angular position, and a second rotational direction such that the second protrusion pushes the first protrusion so as to move the first rotatable member from the second angular position back to the first angular position. The electric driving unit is operable so as to drive rotation of the second rotatable member.

However, since the conventional electric door lock requires different configurations for application to different doors operable to open from different lateral sides, the conventional electric door lock is lacking inflexibility. Additionally, in electrical operation, the second protrusion is configured to slide over the first protrusion so as to prevent the second protrusion from obstructing path of the first protrusion during operation. Since both of the first and second protrusions lack resiliency, service life thereof is relatively short. Moreover, the conventional electric door lock uses a micro-switch as a sensing element for deactivating the electric driving unit, but the micro-switch is relatively unstable.

SUMMARY OF THE INVENTION

Therefore, an object of the present invention is to provide an electric door lock that is adapted to be mounted on a door operable to open from either lateral side, and that has a relatively longer service life.

Accordingly, an electric door lock of the present invention comprises a door latch mechanism, a manual operation mechanism, an electric operation mechanism, first and second rotatable members, and an electric control mechanism.

The door latch mechanism is operable for movement between latching and unlatching positions. The manual operation mechanism includes a spindle coupled operatively to the door latch mechanism, and is manually operable to drive movement of the door latch mechanism between the latching and unlatching positions. The electric operation mechanism includes an electric driving unit. The first rotatable member is driven by the electric driving unit to rotate about an axis, and includes a rotary body and a clutch mechanism. The clutch mechanism is disposed resiliently on the rotary body and is movable parallel to the axis toward and away from the rotary body. The second rotatable member is coupled to the manual operation mechanism for co-rotation with the spindle, and has one side that confronts the first rotatable member and that is provided with a pushed unit. The electric control mechanism is operable so as to deactivate the electric driving unit after the door latch mechanism has been moved from one of the latching and unlatching positions to the other one of the latching and unlatching positions.

When the first rotatable member is driven by the electric driving unit to rotate, the clutch mechanism pushes the pushed unit to drive rotation of the second rotatable member and co-rotation of the spindle for moving the door latch mechanism from one of the latching and unlatching positions to the other one of the latching and unlatching positions.

When the first rotatable member is driven by the electric driving unit to rotate further after the door latch mechanism has been moved from the one of the latching and unlatching positions to the other one of the latching and unlatching positions, the pushed unit causes the clutch mechanism to move parallel to the axis toward the rotary body such that the clutch mechanism slides over the pushed unit and is moved from one side of the pushed unit to a circumferentially opposite side of the pushed unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
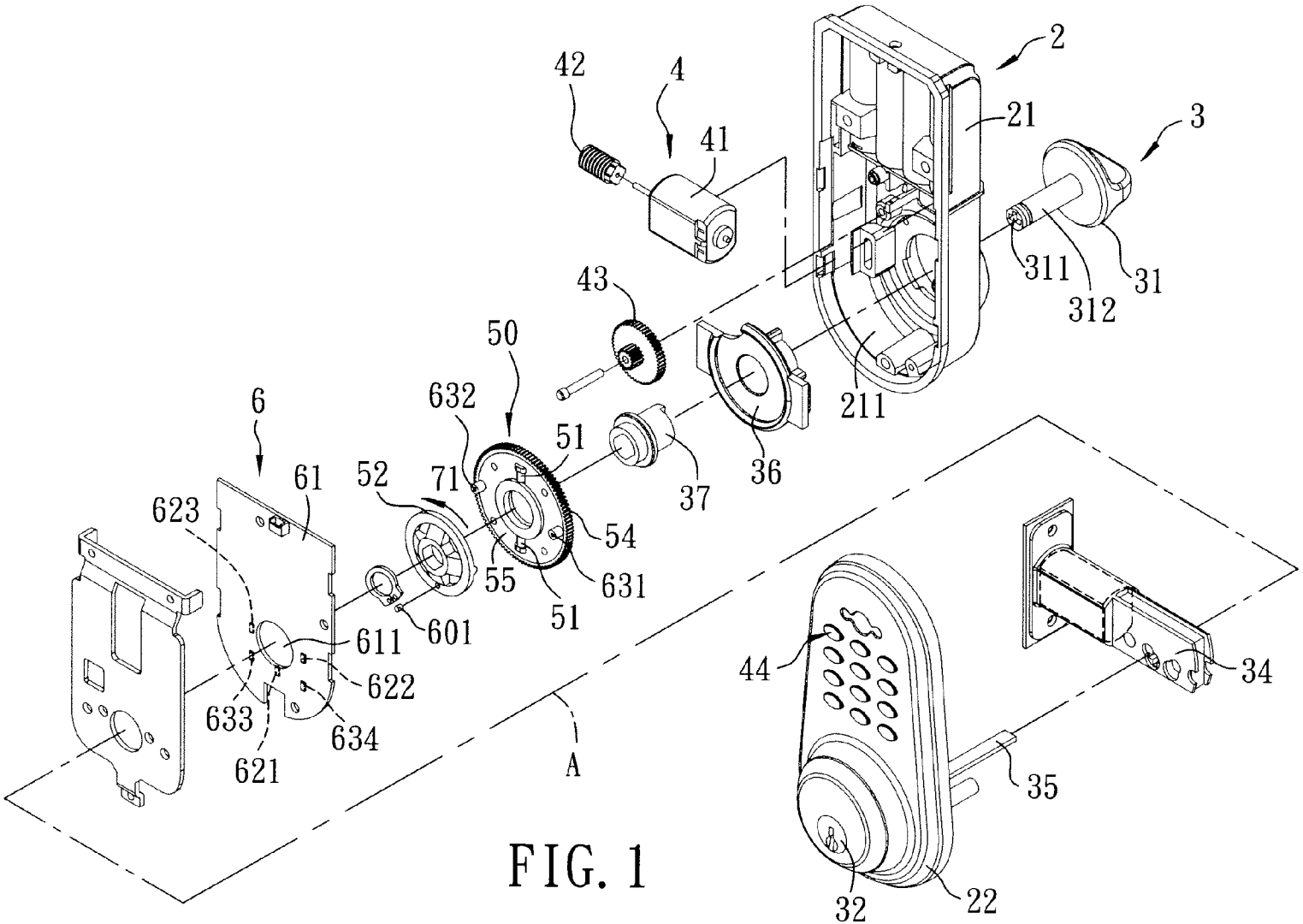
FIG. 1 is an exploded perspective view of a first preferred embodiment of an electric door lock of the present invention.

Before the present invention is described in greater detail, it should be noted that like elements are denoted by the same reference numerals throughout the disclosure.

Figure 2:
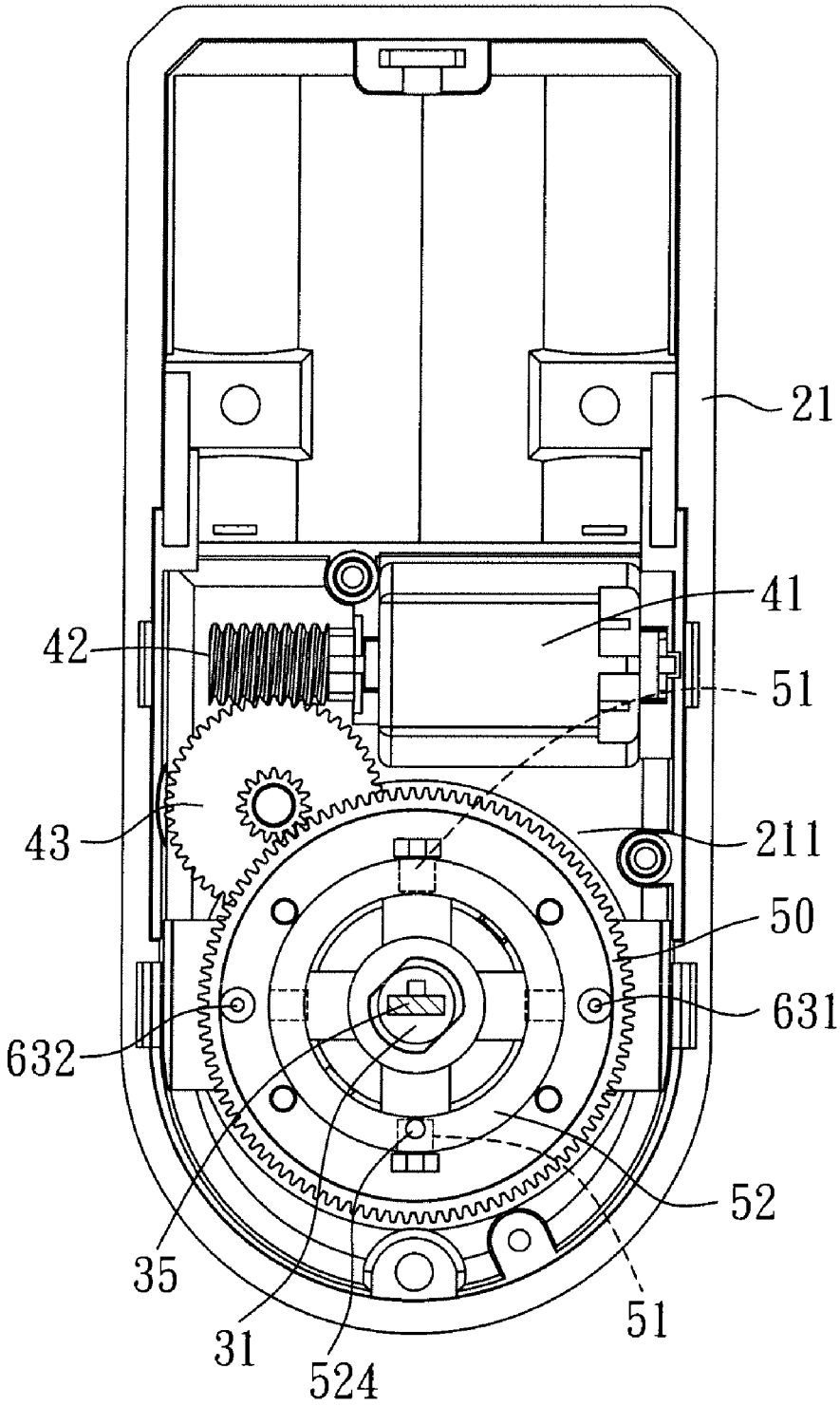
FIG. 2 is a front view of the electric door lock of the first preferred embodiment for illustrating an electric operation mechanism.
Figure 3:
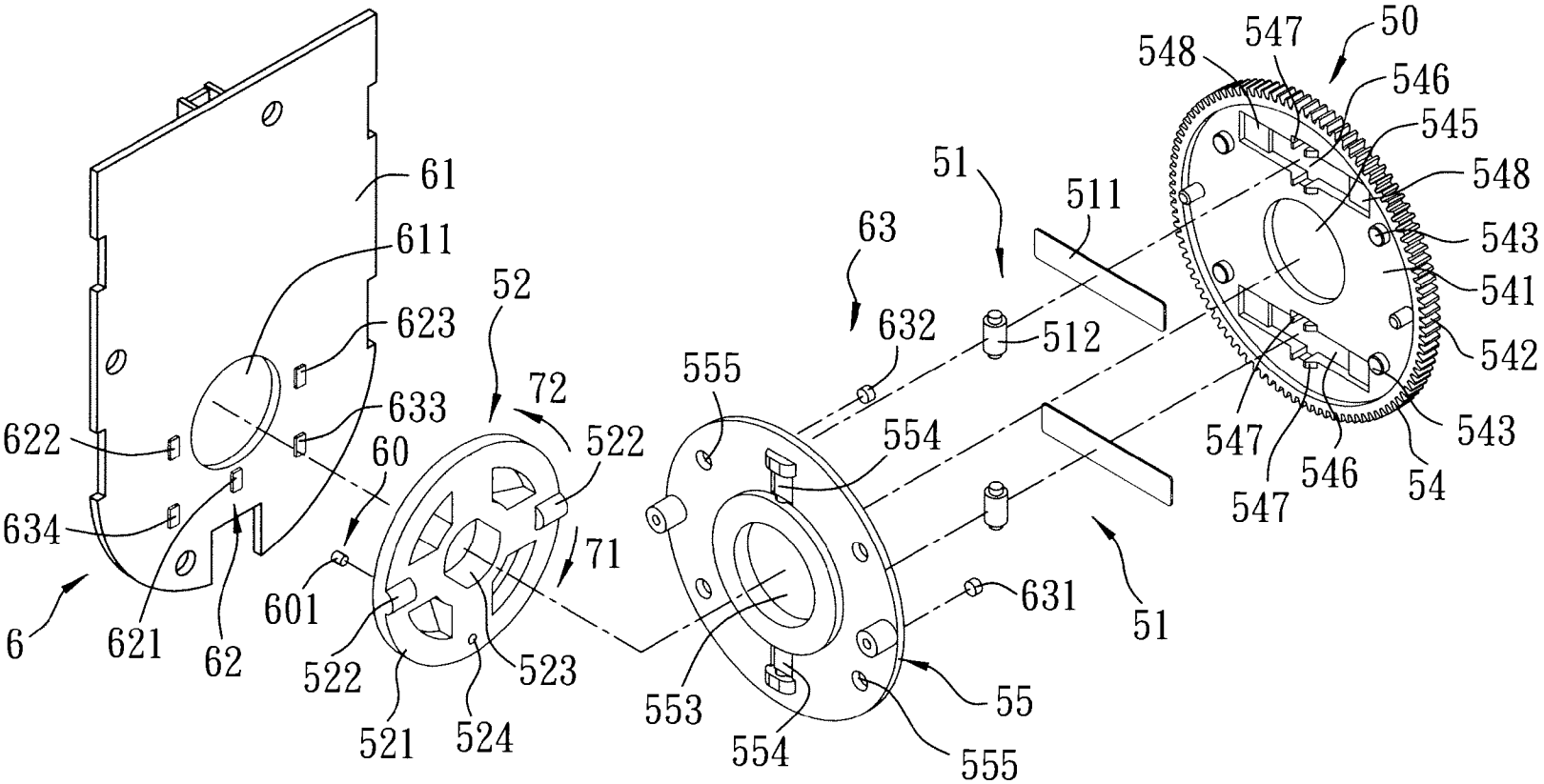
FIG. 3 is a partly exploded perspective view of the electric door lock of the first preferred embodiment for illustrating first and second rotatable members.

Referring to FIGS. 1 to 3, a first preferred embodiment of an electric door lock according to the present invention is adapted to be mounted on a door (not shown) operable to open from either one of right and left lateral sides. It should be noted that the right and left lateral sides are with reference to a user who stands at an outer side of the door and faces the door. The electric door lock includes a housing unit 2, a door latch mechanism 34, a manual operation mechanism 3, an electric operation mechanism 4, a first rotatable member 50, a second rotatable member 52, and an electric control mechanism 6.

In this embodiment, the housing unit 2 includes an internal housing 21 and an external housing 22 that are adapted to be mounted on inner and outer sides of the door, respectively. The internal housing 21 defines an accommodating space 211.

The manual operation mechanism 3 includes amounting seat 36 mounted on the internal housing 21 in the accommodating space 211, a co-rotating sleeve 37 inserted rotatably in the mounting seat 36, a rotary knob 31 mounted rotatably on the internal housing 21 via the mounting seat 36 and the co-rotating sleeve 37, a key-operated plug 32 mounted rotatably on the external housing 22, and a spindle 35 disposed along an axis (A) and coupled operatively to the rotary knob 31, the key-operated plug 32 and the door latch mechanism 34. The rotary knob 31 includes an extending rod 312 extending into the accommodating space 211 through the co-rotating sleeve 37 and formed with a socket 311 for insertion of the spindle 35 such that the spindle 35 is co-rotatable with the rotary knob 31. By rotating the rotary knob 31 or by rotating the key-operated plug 32 with a key (not shown), the door latch mechanism 34 is operable for movement between a latching position and an unlatching position. Since cooperation between the door latch mechanism 34 and the rotary knob 31 or the key-operated plug 32 is well known to those skilled in the art, further details thereof will be omitted herein for the sake of brevity.

The electric operation mechanism 4 includes an electric driving unit 41 (a motor for example), a worm gear 42 driven by the electric driving unit 41, a reduction gear 43 driven by the worm gear 42, and a keypad 44 operable so as to activate the electric driving unit 41. In practice, remote control techniques may be employed for controlling activation of the electric driving unit 41.

The first rotatable member 50 is disposed rotatably around the co-rotating sleeve 37, and is driven by the electric driving unit 41 through the worm gear 42 and the reduction gear 43 to rotate about the axis (A). The first rotatable member 50 includes a rotary body 54, a cover 55 fixedly attached to the rotary body 54, and an oppositely disposed pair of clutch mechanisms 51 between the rotary body 54 and the cover 55.

The rotary body 54 includes a circular wall 541 corresponding to the cover 55, a plurality of teeth 542 disposed on a periphery of the circular wall 541 and engaging the reduction gear 43, and a plurality of projecting rods 543 projecting from the circular wall 541 toward the cover 55. The circular wall 541 is formed with a first circular through hole 545 at a center thereof, and a pair of grooves 546 respectively at a pair of radially opposite sides of the first circular through hole 545. For each of the grooves 546, the circular wall 541 is provided with a pair of mounting components 547 respectively projecting from opposite longitudinal sides of the groove 546 toward the cover 55, and a pair of stops 548 disposed in the groove 546 and adjacent to left and right lateral sides of the groove 546.

The cover 55 is formed with a second circular through hole 553 at a center thereof, a pair of apertures 554 registered respectively with the grooves 546, and a plurality of rod holes 555 for insertion of the projecting rods 543 of the rotary body 54 so as to join the cover 55 to the rotary body 54. The second circular through hole 553 is registered with the first circular through hole 545 in the rotary body 54, and one end of the co-rotating sleeve 37 extends into the first and second circular through holes 545, 553 such that the first rotatable member 50 is rotatable relative to the co-rotating sleeve 37.

The clutch mechanisms 51 are disposed resiliently on the rotary body 54 and are movable parallel to the axis (A) toward and away from the rotary body 54. In this embodiment, each of the clutch mechanisms 51 includes a resilient plate 511 disposed in a corresponding one of the grooves 546 and positioned by the stops 548, and a pushing block 512 mounted on the mounting components 547, extending through a corresponding one of the apertures 554 in the cover 55, and biased by the resilient plate 511 away from the rotary body 54.

The second rotatable member 52 is coupled to the manual operation mechanism 3 for co-rotation with the spindle 35, and has one side confronting the first rotatable member 50 and provided with a pushed unit. The second rotatable member 52 includes a ring body 521, and the pushed unit includes a pair of protrusions 522 disposed at angularly spaced apart positions on the ring body 521. The ring body 521 is formed with a non-circular through hole 523 engaging the extending rod 312 of the rotary knob 31 such that the second rotatable member 52 is co-rotatable with the rotary knob 31, and an assembling hole 524 angularly spaced apart from each of the protrusions 522 by 90 degrees.

The electric control mechanism 6 includes a circuit board 61 formed with a third circular through hole 611, a magnetic unit 60 disposed on the second rotatable member 52, a sensing unit 62 disposed on the circuit board 61 and operably associated with the magnetic unit 60, and a deactivating unit 63 for deactivating the electric driving unit 41.

In this embodiment, the magnetic unit 60 includes a magnetic component 601 that is disposed in the assembling hole 524 in the ring body 521 of the second rotatable member 52 and that is a magnet. The sensing unit 62 includes a first sensor 621 aligned with and configured to sense the magnetic component 601 when the door latch mechanism 34 is at the unlatching position, and second and third sensors 622, 623, one of which is aligned with and is configured to sense the magnetic component 601 when the door latch mechanism 34 is at the latching position. In particular, the second sensor 622 is aligned with the magnetic component 601 when the electric door lock is mounted on a door that is operable to open from the right lateral side and the door latch mechanism 34 is at the latching position, and the third sensor 623 is aligned with the magnetic component 601 when the electric door lock is mounted on a door that is operable to open from the left lateral side and the door latch mechanism 34 is at the latching position. In practice, the first, second and third sensors 621-623 are Hall sensors that are relatively sensitive and durable.

The deactivating unit 63 of the electric control mechanism 6 is operable to deactivate the electric driving unit 41 after the door latch mechanism 34 has been moved from one of the latching and unlatching positions to the other one of the latching and unlatching positions. In this embodiment, the deactivating unit 63 includes a pair of magnets 631, 632 disposed at the first rotary member 50, and a pair of sensors 633, 634 disposed on the circuit board 61. The sensors 633, 634 are Hall sensors, and the magnets 631, 632 are angularly spaced apart from each other by 180 degrees and from the pushing blocks 512 of the clutch mechanisms 51 by 90 degrees. Each of the sensors 633, 634 is configured to sense a corresponding one of the magnets 631, 632 to thereby enable the electric control mechanism 6 to deactivate the electric driving unit 41.

When the door latch mechanism 34 is at the unlatching position as shown in FIGS. 1 to 3, the pushing blocks 512 of the clutch mechanisms 51 are angularly spaced apart from the protrusions 522 by 90 degrees, and the magnetic component 601 disposed on the second rotatable member 52 is aligned with the first sensor 621 disposed on the circuit board 61.

Figure 4:
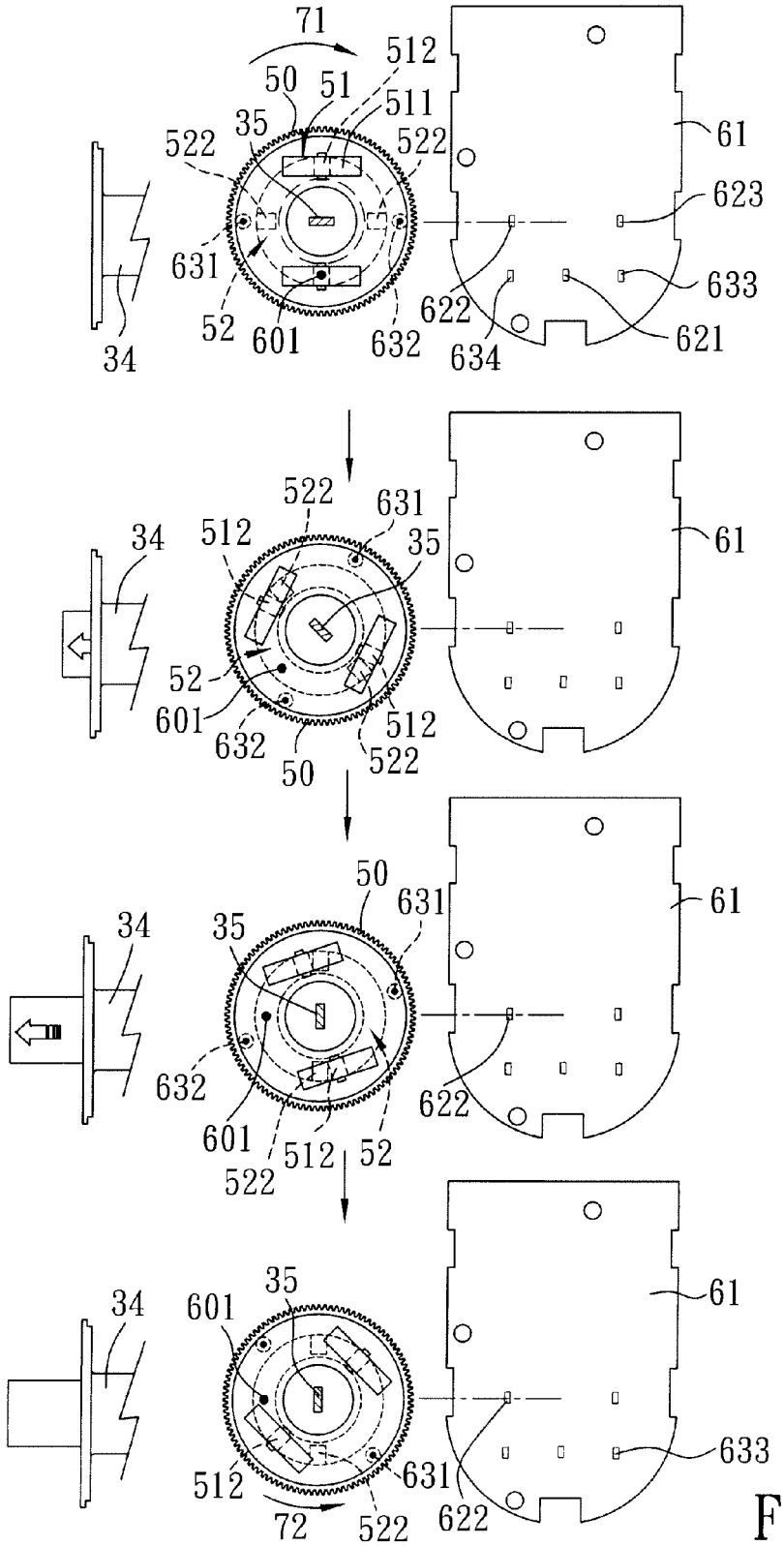
FIG. 4 illustrates schematic views for depicting electrical operation of the electric door lock mounted on a door operable to open from the right side.

When a user wants to lock the electric door lock by manual operation, the user can rotate the rotary knob 31 or the key-operated plug 32 via a key (not shown) to rotate the spindle 35. As shown in FIG. 4, when the spindle 35 is driven to rotate in a first rotational direction 71, the spindle 35 will move the door latch mechanism 34 from the unlatching position to the latching position, and the second rotatable member 52 also co-rotates 90 degrees in the first rotational direction 71. Thus, the magnetic component 601 on the second rotatable member 52 rotates 90 degrees and is aligned with and sensed by the second sensor 622 on the circuit board 61. At this time, the electric control mechanism 6 is operable to determine that the electric door lock is mounted on a door operable to open from the right lateral side and that the door latch mechanism 34 is at the latching position. Similarly, when the user wants to unlock the electric door lock by manual operation, the user can just rotate the rotary knob 31 or the key-operated plug 32 in a second rotational direction 72 that is opposite to the first rotational direction 71, and the second rotatable member 52 and the magnetic component 601 will be restored to the positions as shown in FIG. 1.

Figure 5:
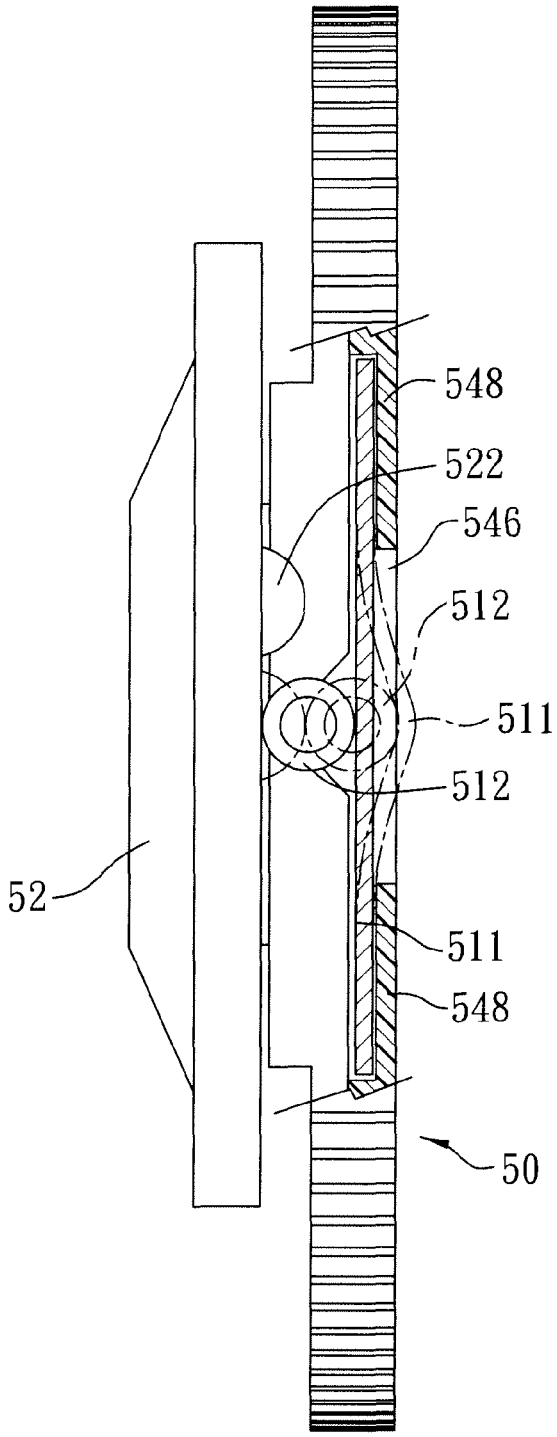
FIG. 5 is a partly cross-sectional view of the electric door lock of the first preferred embodiment for illustrating a clutch mechanism during operation.

Referring to FIGS. 1, 4 and 5, when the user wants to lock the electric door lock by electrical operation, the user can use the keypad 44 of the electric operation mechanism 4 or a remote controller (not shown) to activate the electric driving unit 41. When the electric driving unit 41 drives the first rotatable member 50 to rotate in the first rotational direction 71 through the worm gear 42 and the reduction gear 43, each of the pushing components 512 of the clutch mechanisms 51 disposed at the first rotatable member 50 will abut against and push a corresponding one of the protrusions 522 so as to drive rotation of the second rotatable member 52 and co-rotation of the spindle 35 for moving the door latch mechanism 34 from the unlatching position to the latching position. At the latching position, the magnetic component 601 on the second rotatable member 52 is aligned with and sensed by the second sensor 622 on the circuit board 61 such that the electric control mechanism 6 is operable to determine that the door latch mechanism 34 is at the latching position.

It should be noted that, in order to prevent interference with the manual operation and shorten movement during the electrical operation, the deactivating unit 63 is operable to deactivate the electric driving unit 41 during the electrical operation. In particular, after the spindle 35 has rotated 90 degrees in the first rotational direction 71 and has moved the door latch mechanism 34 from the unlatching position to the latching position, the spindle 35 and the second rotatable member 52 are held in place and the electric driving unit 41 still drives the first rotatable member 50 to rotate in the first rotational direction 71. Therefore, each of the protrusions 522 will cause a corresponding one of the pushing blocks 512 to move parallel to the axis (A) against biasing action of the corresponding one of the resilient plates 511 so as to deform the corresponding one of the resilient plates 511 such that the corresponding one of the pushing blocks 512 slides over the protrusion 522 and is moved from one side of the protrusion 522 to a circumferentially opposite side of the protrusion 522. When the magnet 631 disposed on the first rotatable member 50 is aligned with and sensed by the sensor 633 disposed on the circuit board 61, the electric control mechanism 6 is operable to deactivate the electric driving unit 41.

Subsequently, when the user manually operates the electric door lock, the clutch mechanisms 51 will not interfere with the rotation of the rotary knob 31 and co-rotation of the second rotatable member 52 in the second rotational direction 72 during the manual operation. Alternatively, when the user electrically operates the electric door lock, the pushing blocks 512 will immediately abut against and push the protrusions 522 while the first rotatable member 50 rotates in the second rotational direction 72.

Figure 6:
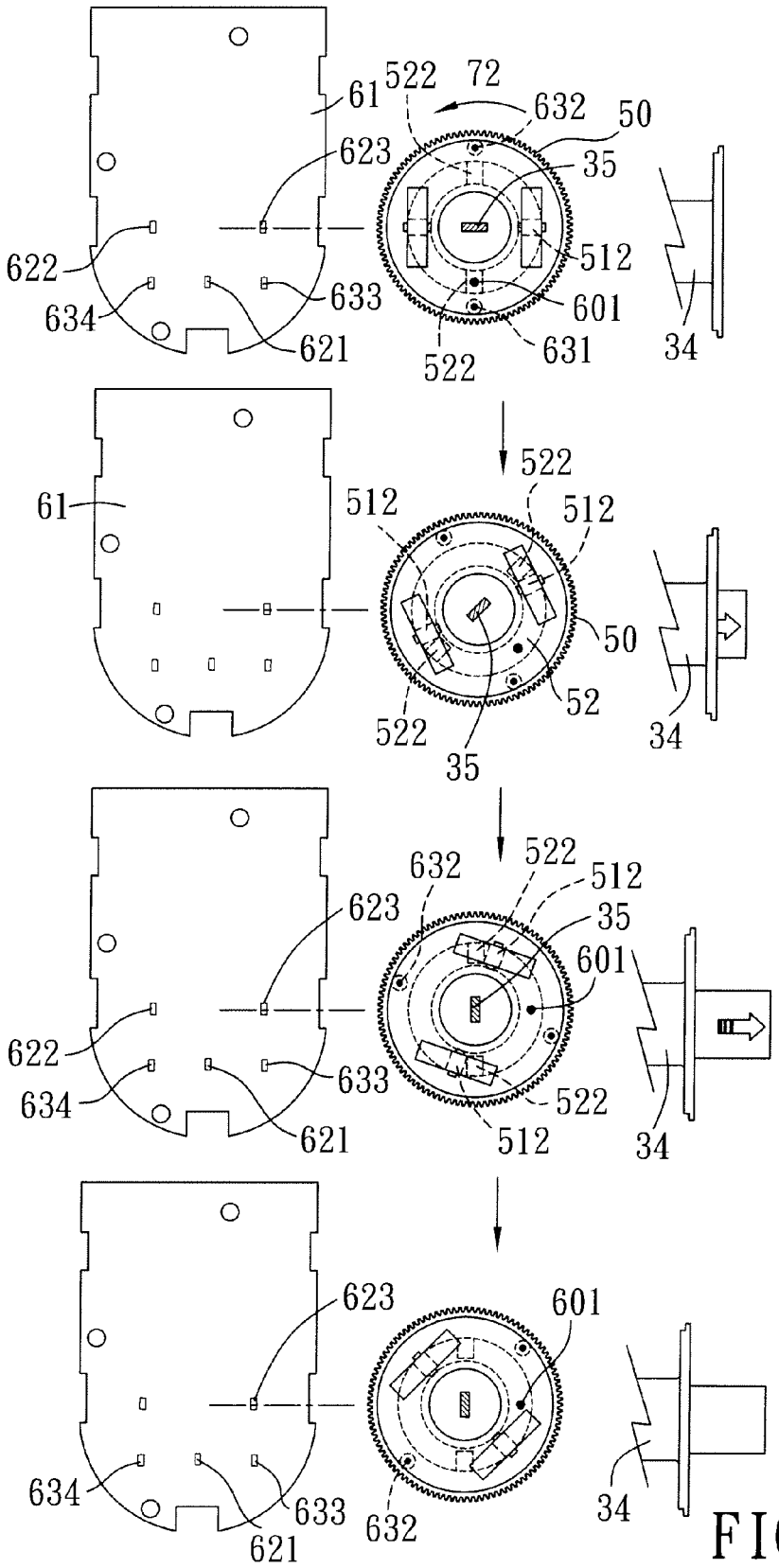
FIG. 6 illustrates schematic views for depicting electrical operation of the electric door lock mounted on a door operable to open from the left side.

The foregoing description illustrates the operation of the electric door lock of the present invention that is mounted on the door operable to open from the right lateral side. When the electric door lock is mounted on a door that is operable to open from the left lateral side, operation thereof is similar to the above-mentioned operation but the rotational directions are reversed. Referring to FIGS. 1 and 6, rotation of the first rotatable member 50 in the second rotational direction 72 will result in movement of the door latch mechanism 34 from the unlatching position to the latching position during the electric operation. At this time, the magnetic component 601 is aligned with and sensed by the third sensor 623 on the circuit board 61 such that the electric control mechanism 6 is operable to determine that the door latch mechanism 34 is at the latching position. Each of the pushing blocks 512 similarly slides over a corresponding one of the protrusions 522, and is moved from one side of the corresponding one of the protrusions 522 to a circumferentially opposite side of the corresponding one of the protrusions 522. In this case, the magnet 632 will be aligned with and sensed by the sensor 634 so as to enable the electric control mechanism 6 to deactivate the electric driving unit 41. In other embodiments, the electric control mechanism 6 may be configured to deactivate the electric driving unit 41 according to time.

Figure 7:
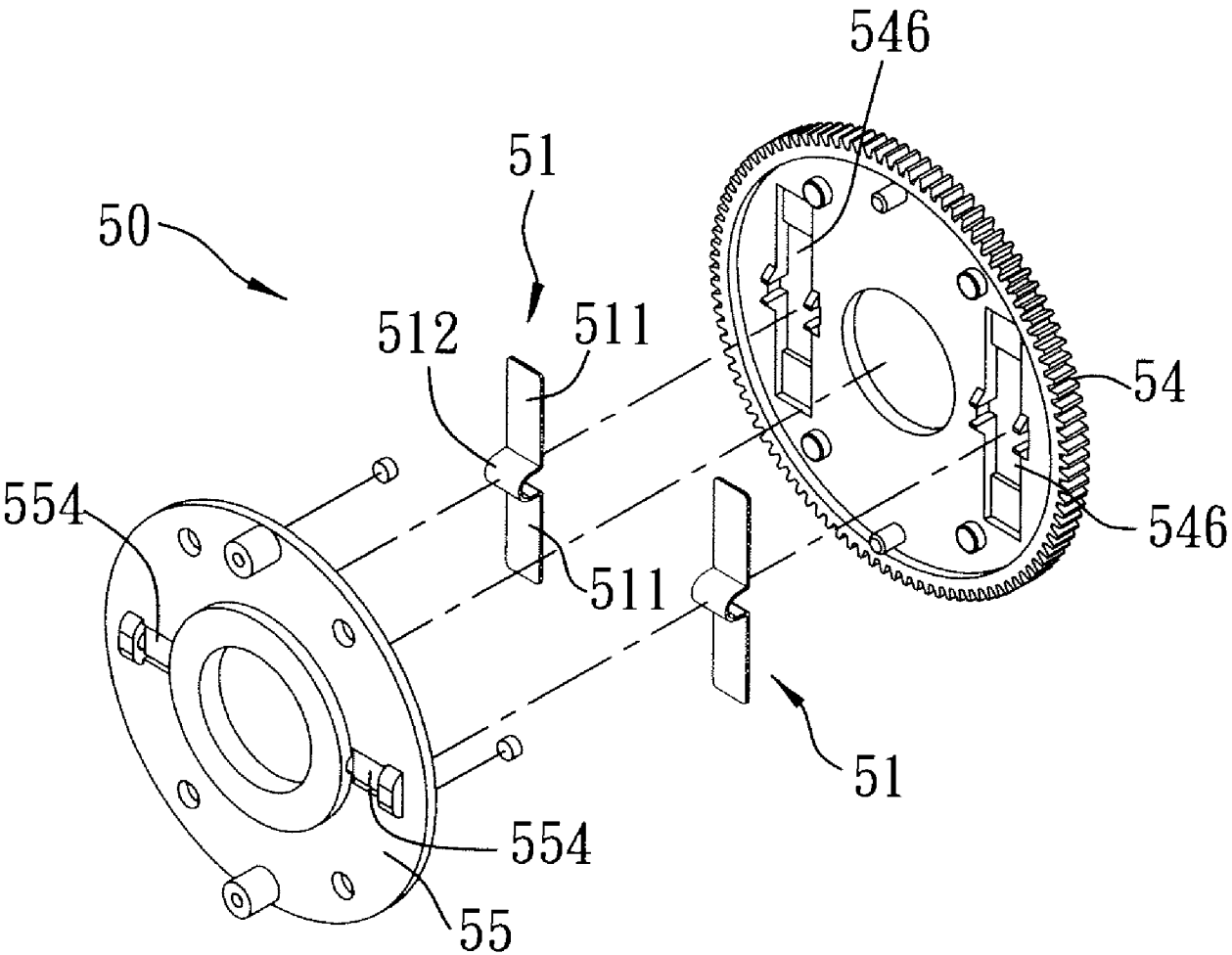
FIG. 7 is a partly exploded perspective view of a second preferred embodiment of an electric door lock of the present invention for illustrating first and second rotatable members.
Figure 8:
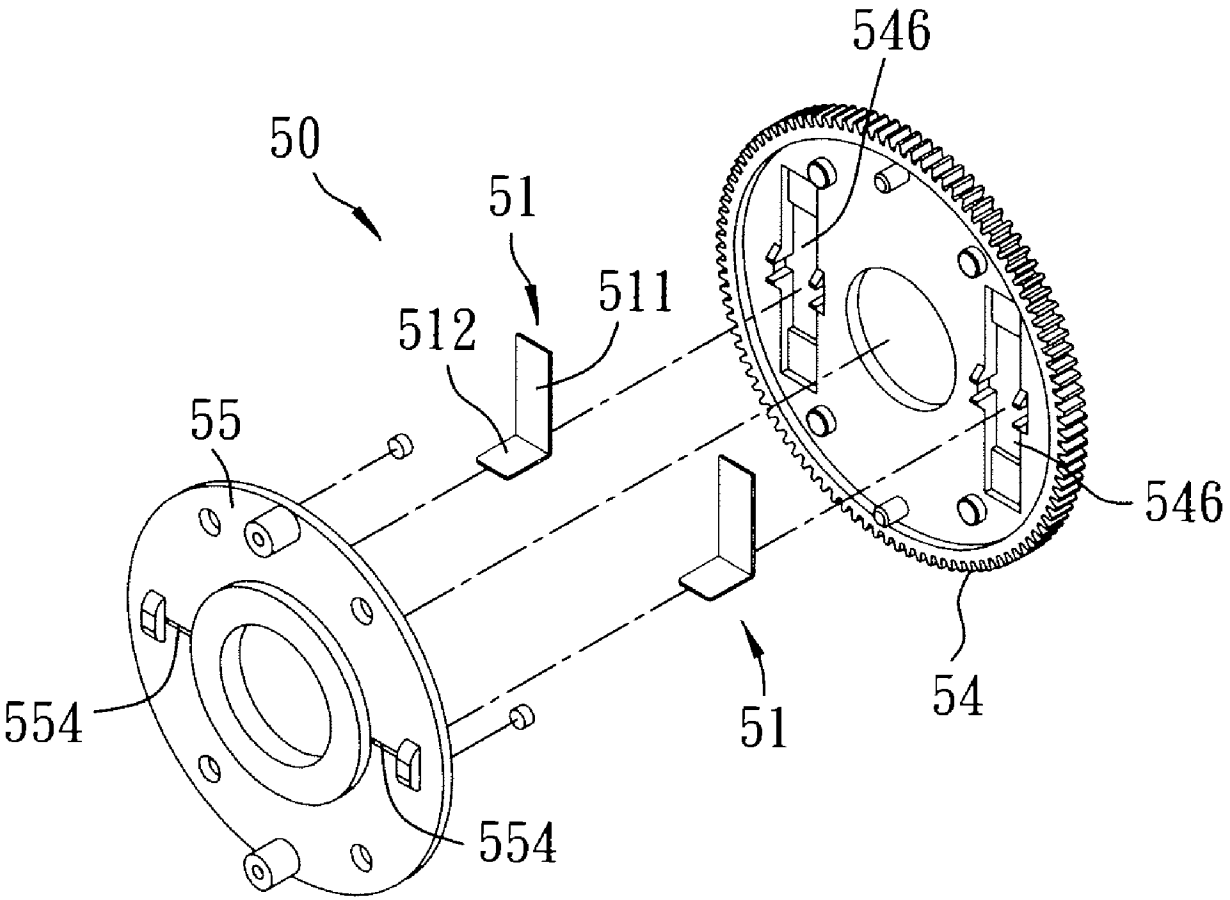
FIG. 8 is a partly exploded perspective view of a third preferred embodiment of an electric door lock of the present invention for illustrating first and second rotatable members.

Referring to FIGS. 7 and 8, second and third preferred embodiments of an electric door lock of the present invention are shown to be similar to the electric door lock of the first preferred embodiment. In the second preferred embodiment shown in FIG. 7, each of the clutch mechanisms 51 is formed integrally as a resilient plate that has a pair of securing parts 511 received in a corresponding one of the grooves 546 in the rotary body 54, and a pushing part 512 connected to and projecting from the securing parts 511. The pushing part 512 extends through a corresponding one of the apertures 554 in the cover 55 so as to act upon a corresponding one of the protrusions 522 (see FIG. 3). In the third preferred embodiment shown in FIG. 8, each of the clutch mechanisms 51 is also formed integrally as a resilient plate that has a securing part 511 received in a corresponding one of the grooves 546 in the rotary body 54, and a pushing part 512 projecting perpendicularly from the securing part 511 toward the cover 55. The pushing part 512 extends through a corresponding one of the apertures 554 in the cover 55 so as to act upon a corresponding one of the protrusions 522 (see FIG. 3). In other embodiments, the clutch mechanisms 51 may be modified further as long as the function described in the disclosed embodiments is maintained.

Figure 9:
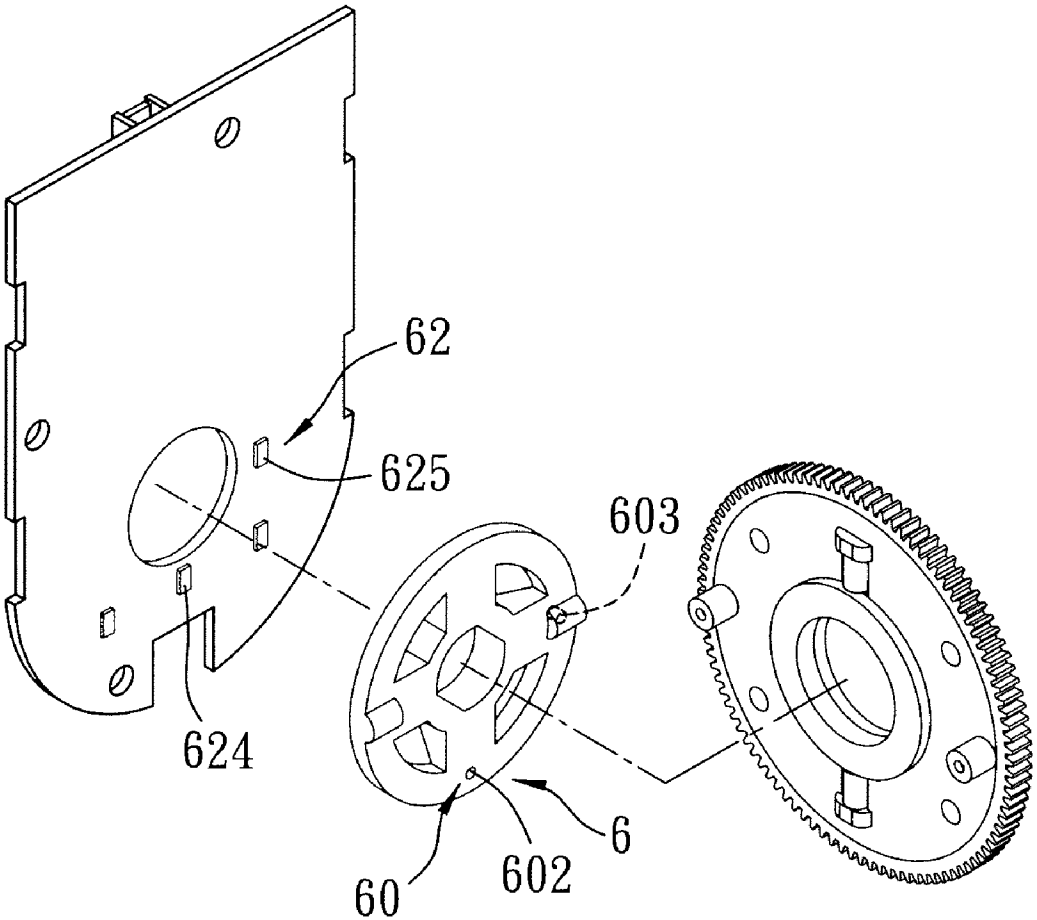
FIG. 9 is a partly exploded perspective view of a fourth preferred embodiment of an electric door lock of the present invention for illustrating first and second rotatable members and an electric control mechanism.
Figure 10:
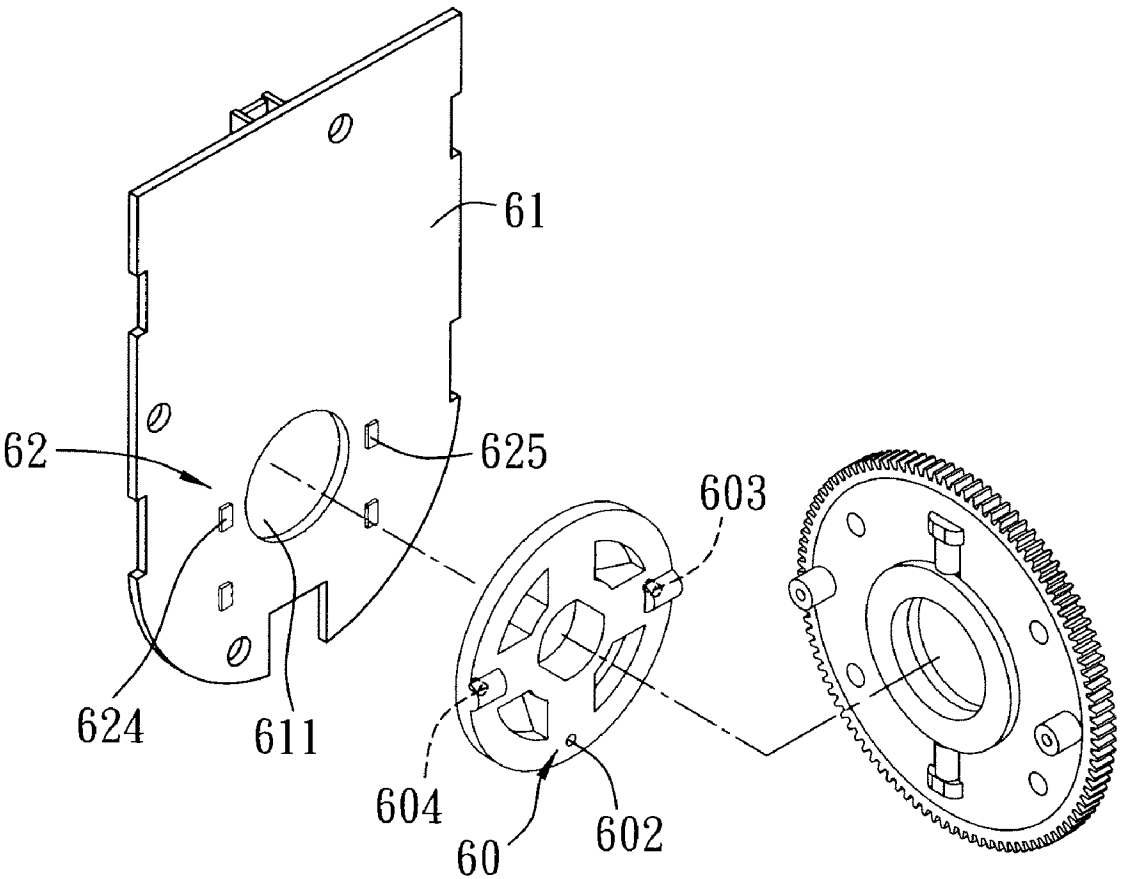
FIG. 10 is a partly exploded perspective view of a fifth preferred embodiment of an electric door lock of the present invention for illustrating first and second rotatable members and an electric control mechanism.

Referring to FIGS. 9 and 10, fourth and fifth preferred embodiments of an electric door lock of the present invention are shown to be similar to the electric door lock of the first preferred embodiment. In the fourth preferred embodiment shown in FIG. 9, the magnetic unit 60 of the electric control mechanism 6 includes a pair of magnetic components 602, 603 angularly spaced apart from each other by 90 degrees, and the sensing unit 62 of the electric control mechanism 6 includes a pair of sensors 624, 625 spaced apart from each other by 90 degrees. The sensors 624, 625 are configured to sense the magnetic components 602, 603 so as to determine whether the door latch mechanism 34 is at one of the latching and unlatching positions. In the fifth preferred embodiment shown in FIG. 10, the magnetic unit 60 of the electric control mechanism 6 includes three magnetic components 602-604 angularly spaced apart from each other by 90 degrees, and the sensing unit 62 of the electric control mechanism 6 includes a pair of sensors 624, 625 angularly spaced apart from each other by 180 degrees.

In other embodiments, number and arrangement of components of the magnetic unit 60 and the sensing unit 62 may vary. Arrangement of the sensors surrounding the third circular through hole 611 in the circuit board 61 is not limited to the disclosed embodiments. The sensors can be arranged at other predetermined angular positions to surround the third circular through hole 611, and the electric control mechanism 6 can still control operation of the electric driving unit 41 precisely. Figures for illustrating other arrangements of the sensors are omitted herein for the sake of brevity.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electric door lock comprising:

a door latch mechanism operable for movement between latching and unlatching positions;

a manual operation mechanism including a spindle coupled operatively to said door latch mechanism, said manual operation mechanism being manually operable to drive movement of said door latch mechanism between the latching and unlatching positions;

an electric operation mechanism including an electric driving unit;

a first rotatable member driven by said electric driving unit to rotate about an axis, said first rotatable member including a rotary body formed with a groove, and a clutch mechanism;

a second rotatable member coupled to said manual operation mechanism for co-rotation with said spindle, said second rotatable member having one side that confronts said first rotatable member and that is provided with a pushed unit;

wherein said clutch mechanism includes a resilient plate disposed in said groove in said rotary body, and a pushing block biased by said resilient plate away from said rotary body and disposed to act upon said pushed unit to move parallel to the axis;

wherein, when said first rotatable member is driven by said electric driving unit to rotate, said pushing block of said clutch mechanism pushes said pushed unit to drive rotation of said second rotatable member and co-rotation of said spindle for moving said door latch mechanism from one of the latching and unlatching positions to the other one of the latching and unlatching positions;

wherein, when said first rotatable member is driven by said electric driving unit to rotate further after said door latch mechanism has been moved from said one of the latching and unlatching positions to the other one of the latching and unlatching positions, said pushed unit causes said pushing block of said clutch mechanism to move parallel to the axis toward said rotary body such that said pushing block slides over said pushed unit and is moved from one side of said pushed unit to a circumferentially opposite side of said pushed unit; and an electric control mechanism for deactivating said electric driving unit after said door latch mechanism has been moved from said one of the latching and unlatching positions to the other one of the latching and unlatching positions.

2. The electric door lock as claimed in claim 1, further comprising a housing unit that includes an external housing and an internal housing, said manual operation mechanism further including a rotary knob mounted rotatably on said internal housing and coupled operatively to said spindle, and a key-operated plug mounted rotatably on said external housing and coupled operatively to said spindle.

3. The electric door lock as claimed in claim 1, wherein said second rotatable member includes a ring body and said pushed unit includes a pair of protrusions disposed at angularly spaced apart positions on said ring body.

4. The electric door lock as claimed in claim 1, wherein said electric control mechanism includes a circuit board, a magnetic unit disposed on said second rotatable member, and a sensing unit disposed on said circuit board and operably associated with said magnetic unit so as to determine whether said door latch mechanism is at one of the latching and unlatching positions.

5. The electric door lock as claimed in claim 4, wherein said second rotatable member includes a ring body provided with said pushed unit, said magnetic unit of said electric control mechanism including a magnetic component disposed on said ring body of said second rotatable member and angularly spaced apart from said pushed unit, said sensing unit of said electric control mechanism including a first sensor aligned with and configured to sense said magnetic component when said door latch mechanism is at the unlatching position, and a second sensor aligned with and configured to sense said magnetic component when said door latch mechanism is at the latching position.

6. The electric door lock as claimed in claim 5, wherein said magnetic component is a magnet, and said first and second sensors are Hall sensors.

7. The electric door lock as claimed in claim 4, wherein said second rotatable member includes a ring body and said pushed unit includes a pair of protrusions disposed at angularly spaced apart positions on said ring body.

8. The electric door lock as claimed in claim 7, wherein:

said magnetic unit of said electric control mechanism includes a magnetic component disposed on said ring body of said second rotatable member and angularly spaced apart from said protrusions; and said sensing unit of said electric control mechanism includes a first sensor aligned with and configured to sense said magnetic component when said door latch mechanism is at the unlatching position, a second sensor aligned with and configured to sense said magnetic component when said electric door lock is mounted on a door that is operable to open from a first lateral side and said door latch mechanism is at the latching position, and a third sensor aligned with and configured to sense said magnetic component when said electric door lock is mounted on a door that is operable to open from a second lateral side opposite to the first lateral side and said door latch mechanism is at the latching position.

9. The electric door lock as claimed in claim 8, wherein said magnetic component is a magnet, and said first, second and third sensors are Hall sensors.

10. The electric door lock as claimed in claim 4, wherein said electric control mechanism further includes:

a pair of magnets disposed at said first rotatable member and angularly spaced apart from each other and from said clutch mechanism; and a pair of sensors configured to sense said magnets to thereby enable said electric control mechanism to deactivate said electric driving unit after said clutch mechanism slides over said pushed unit.

11. The electric door lock as claimed in claim 1, wherein said first rotatable member further includes a cover joined to said rotary body and formed with an aperture registered with said groove in said rotary body;

wherein said rotary body includes a pair of mounting components respectively projecting from opposite longitudinal sides of said groove toward said cover, and a pair of stops disposed in said groove and adjacent to left and right lateral sides of said groove;

wherein said resilient plate is disposed in said groove and is positioned by said stops, and said pushing block is mounted on said mounting components and extends through said aperture in said cover.

* * * * *